United States Patent [19]

Parmer

[11] Patent Number: 4,789,349

[45] Date of Patent: Dec. 6, 1988

[54] THERMAL CONTRACTION CONDUCTOR JOINT

[75] Inventor: Jerome F. Parmer, San Diego, Calif.

[73] Assignee: General Dynamics Corp./Space Systems Division, San Diego, Calif.

[21] Appl. No.: 10,662

[22] Filed: Feb. 4, 1987

[51] Int. Cl.[4] ..... H01R 43/04

[52] U.S. Cl. ..... 439/161; 174/94 R; 174/DIG. 8; 403/340; 439/932

[58] Field of Search ..... 439/161, 932; 174/94 R; 29/871-873, 447; 264/230; 403/28, 30, 339, 340

[56] References Cited

U.S. PATENT DOCUMENTS

| | | | |
|---|---|---|---|
| 925,293 | 6/1909 | Cheney | 403/340 |
| 3,568,130 | 3/1971 | Hurst | 439/161 |
| 4,195,902 | 4/1980 | Caveney et al. | 439/932 |
| 4,237,609 | 12/1980 | Clabburn et al. | 439/932 |
| 4,472,222 | 9/1984 | Moisson et al. | 264/230 |
| 4,514,031 | 4/1985 | Lionnet | 439/932 |

FOREIGN PATENT DOCUMENTS

| | | | |
|---|---|---|---|
| 1502148 | 10/1966 | France | 403/340 |

*Primary Examiner*—Gil Weidenfeld
*Assistant Examiner*—Paula A. Austin
*Attorney, Agent, or Firm*—John R. Duncan; Frank D. Gilliam

[57] ABSTRACT

A joint assembly for holding electrical conductors together comprises a connector which loosely engages the conductors when the assembly is subjected to relatively high temperatures. The connector is made of a material which has a sufficiently higher coefficient of expansion then the coefficient of expansion the material used for the electrical conductors in order to cause a differential shrinkage of the connector onto the conductors for a clamping engagement therebetween when the assembly is subjected to relatively low temperatures.

7 Claims, 1 Drawing Sheet

THERMAL CONTRACTION CONDUCTOR JOINT

BACKGROUND OF THE INVENTION

The present invention pertains to conductor joints useful for carrying large electrica currents with relatively low power consumption. More particularly, the present invention relates to a conductor joint which incorporates a connector that shrinks onto and clampingly engages conductors when the combination is subjected to relatively low temperature. The present invention is particularly, but not exclusively, useful for correcting conductors used to activate magnets at temperature near 77 degrees Kelvin.

DESCRIPTION OF THE PRIOR ART

Various devices have been suggested and disclosed for splicing or correcting electrical conductors. In each case, there has been concern for providing protection of the splice while insuring both a good mechanical bond between the conductors and an effective electrical connection. As one should suspect, these objectives have been accomplished in several different ways. For example, U.S. Pat. No. 4,370,518 to Guzy uses a heat shrinkable band together with adhesives to secure the joint in the areea of the splice. Another approach to the problem is disclosed in U.S. Pat. No. 4,214,121 to Charneski, et al., which teaches the use of a compound of thermosetting hardening resin having embedded metal particles for joining electrical conductors. Further, welding or soldering joints as disclosed in U.S. Pat. No. 4,166,920 to Friedrich et al., is known. Also, the use of an external connecting sleeve disposed in surrounding relationship to the joined conductors is well known. Indeed, several means for connecting a sleeve to the conductors have been suggested. These means include a threaded engagement as disclosed in U.S. Pat. No. 4,163,599 to Plugge et al., a bracketed interconnect with adjustable tension rods as disclosed in U.S. Pat. No. 3,816,639 to Anderson et al., and crimping as disclosed in U.S. Pat. No. 3,673,313 to Pickett et al. In each case, however, the spliced joint is intended to be permanent or at least semi-permanent.

In accordance with the present invention it is recognized that there are circumstances in which it is desirable to have a secure connection yet also have an easy disconnect of the joined conductors. Unlike the prior art, the present invention also recognizes that physical characteristics of the operating environemt may be used to advantage in helping form the connection between electrical conductors. This is particularly so if the operating environment is a place, such as interstellar space, where temperatures are extremely low relative to room temperature.

In light of the above, it is an object of the present invention to provide a joint connector which is simple to assemble without requiring any special manual dexterity of technical skills and easy to separate. Another object of the present invention is to provide a joint connector which tightly grips and holds conductors in electrical contact when the combination is subjected to relatively low temperatures. Yet another object of the present invention is to provide a relatively inexpensive, easily manufactured joint connector which is rugged and reliable.

SUMMARY OF THE INVENTION

A preferred embodiment of the present invention includes a pair of conductors, each of which is formed with a scarf that is fayed to the scarf of the other conductor. A sheath made of a material, e.g. aluminum, which has a higher coefficient of expansion than the material used to manufacture the conductors, e.g. copper, is disposed in surrounding relationship to the fayed scarfs at near room temperature. Shrinkage of the sheath onto the fayed scarf mechanically connect the conductors and clamps them into electrical contact whenever the combination is subjected to extremely low temperature.

An alternate embodiment of the present invention considers forming the conductors with extensions, rather than scarfs, and providing a grip having recesses for receiving the extensions therein. In a manner the same or that contemplated for the preferred embodiment, differential rates of shrinkage cause the grip to clamp onto the extension of the conductors when the combination is subjected to extremely low temperature.

In yet another embodiment of the present invention the conductors are formed with cavities and pins are inserted into the cavities at room temperature. In this embodiment the coefficient of expansion for the conductors is greater than that for the pins. This is so because,. when the assembly is subjected to very low temperture, clamping engagement between the conductors and the pin is caused by shrinkage of the conductors onto the pins.

The novel features of this invention as well as the invention itself both as to its organization and operation will be best understood from the accompanying drawings taken in conjunction with the accompanying description in which similar reference characters refer to similar parts and in which:

DESCRIPTION OF THE PREFERRED EMBODIMENT

Figure 1A:
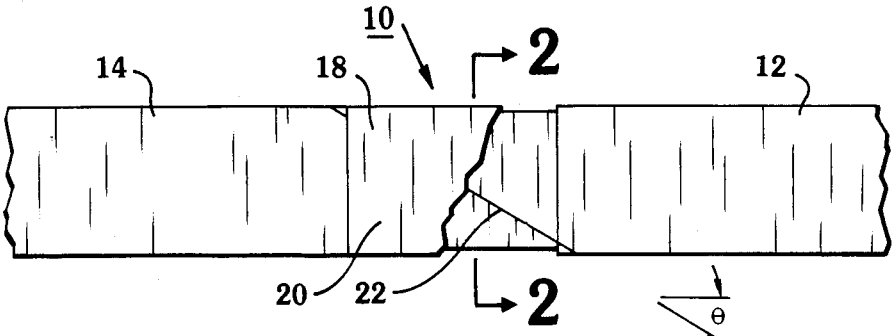
FIG. 1A is a top plan view of a scarf joint according to the present invention with portions shown in phantom for clarity.

Referring initially to FIG. 1A it can be seen that the connector assembly or joint of the present invention, generally designated 10, includes a conductor 12 and a conductor 14 which are joined together and held in place by a sheath 16. More specifically, conductor 12 is formed with a scarf 18 and conductor 14 is conformed with a scard 20. As shown in FIG. 1A, scarf 18 is fayed with scarf 20 to establish a surface 22 therebetween. In the contemplation of the present invention, the surface 22 is oriented at an angle $\theta$ relative to the longitudinal axis of the conductors 12, 14 to minimize slippage between the conductors 12, 14. It will be apprciated by the skilled artist that this condition is realized when the coefficient of friction between the conductor 12, 14 satisfies the relationship $\tan \theta < \mu$.

Figure 1B:
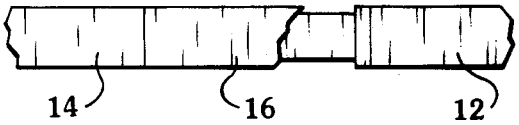
FIG. 1B is a side view of the scarf joint shown in FIG. 1A again with portions shown in phantom for clarity.

Cross reference FIG. 1A with FIG. 1B shows that sheath 16 may be dimensional to provide flush surface contact between the conductors 12, 14 and sheath 16. The relationship of these same components can be further appreciated by reference to FIG. 2 wherein it is seen that the scarf 18, 20 of conductor 12, 14 positioned within the sheath 16 which is disposed in surrounding relationship to the scarfs 18, 20.

Figure 2:
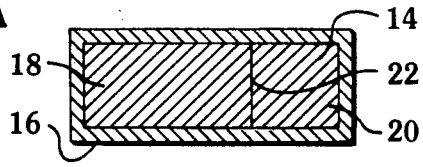
FIG. 2 is a cross sectional view of the scarf joint shown in FIG. 1A as seen on line 2—2 in FIG. 1A.

Importantly, for the structure of the present invention shown in FIG. 1A, FIG. 1B and FIG. 2, the conductors 12, 14 need to be made of a material which has a coefficient of expansion $\beta$hd 1, that is less than the coefficient of expansion $\beta_2$ of the material used for sheath 16. This is so because the clamping engagement of sheath 16 onto the fayed scarfs 18, 20 of conductors 12, 14 is accomplished when extremely low temperature cause a differential shrinkage that results in greater shrinkage of the sheath 16 than the conductors 12, 14. Thus, as will be appreciated by those skilled in the art, conductors 12, 14 may be slidingly and loosely disposed within sheath 16 when the combination is at room temperature. When the combination is subjected to very low temperature, however, sheath 16 will clamping engage the conductors 12, 14 due to greater shrinkage of sheath 16 during the transition through the temperature differential.

It will be appreciated by the skilled artisan that the relative differential shrinkage between conductors 12, 14 and sheath 16 necessary for the cooperation of structure for the present invention can be accomplished using various combinations of materials. The only limitation, in this regard, is the the coefficients of expansion for the selected materials allow for an appropriate differential shrinkage to accomplish the intended purposes of the present invention. Preferably the material used for the conductors 12, 14 will be copper and the material used for the sheath 16 will be aluminum or silver moly. Although other materials may also be suitable, these materials are known to create a joint 10 whose thermal mass is almost as great as the conductors 12, 14 themselves. This fact helps alleviate any problems that might otherwise arise which would be caused by localized heating of the joint 10.

Figure 3B:
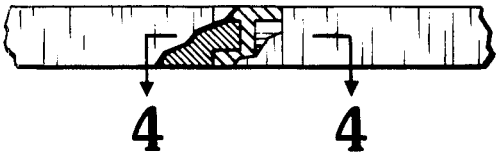
FIG. 3B is a side view of the alternate embodiment shown in FIG. 3A again with portions shown in phantom for clarity.
Figure 3A:
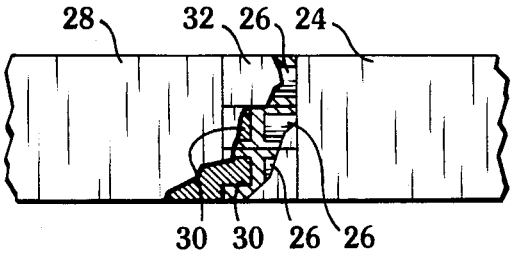
FIG. 3A is a top plan view of an alternate embodiment of the present invention with portions shown in phantom for clarity.
Figure 4:
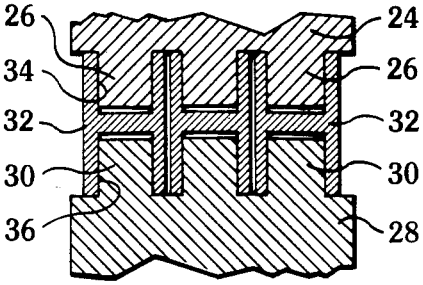
FIG. 4 is a cross sectional view of the alternate embodiment as seen along the line 4—4 in FIG. 3B.

An alternate embodiment of the present invention is seen in FIGS. 3A, 3B, and 4. Referring first to FIG. 3A it can be seen that a conductor 24 is formed with a plurality of extensions 26. Likewise, a conductor 28 is formed with a plurality of extensions 30. In FIG. 4 it can be seen that the extensions 26, 30 are associated with a grip 32. As best seen in FIG. 4, each grip 32 is formed with oppositely oriented recesses 34 and 36 into which respective extensions 26, 30 can be loosely inserted at near room temperatures. Using the same principle discussed above for the preferred embodiment, this alternate embodiment accomplishes the intended purpose of the present invention when the entire assembly 10 is subjected to extremely low temperature. Under such conditions, the grip 32 will shrink onto and clampingly engage the extentions 26, 30 to hold conductors 24, 28 in electrical contact with each other. As with the preferred embodiment this requires that the grips 32 have a thermal coefficient of expansion $\beta_1$, that is sufficiently greater than the thermal coefficient of expansion $\beta_2$ for the conductors 24, 28 to cause the grip 32 to tighten onto the extension 26, 30 when the combination is subjected to very low temperatures. It will be understood by the skilled artisan that this alternate embodiment is operational with the use of a single grip 32. As shown is FIGS. 3A, 3B and 4, a plurality of grips 32 may be used and may be preferable is it is desirable or necessary to eliminate or minimize relative twisting of the conductors 24, 28.

Figure 5A:
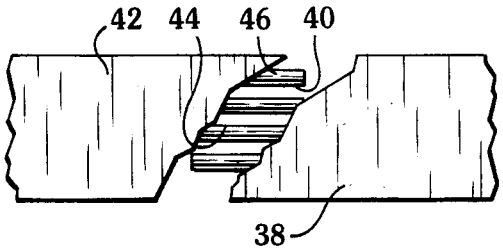
FIG. 5A is a top plan view of another embodiment of the present invention with portions when in phantom for clarity.
Figure 5B:
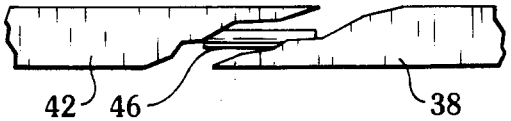
FIG. 5B is a side view of the embodiment shown in FIG. 5A, again with portions shown in phantom for clarity.

In yet another embodiment of the present invention, as shown in FIGS. 5A and 5B, a conductor 38 is formed with a cavity 40. Likewise a conductor 42 is formed with a cavity 44. It will be understood that the conductor 38, 42 may be respectively formed with a plurality of cavities 40, 44 depending upon the needs and desires of the operator. As with other embodiments of the present invention, the conductors 38, 42 can be loosely joined with a connector at near room temperature. In this case the connectors are pins 46. Also, as with the other embodiments of the present invention, the clamping engagement of the conductors 38, 42 onto the connector is accomplished by differential shrinkage between the components of the connector assembly 10 as the assembly 10 is subjected to very low temperatures. In the case of this embodiment, however, the coefficient of thermal expansion $\beta_2$ of the conductors 38, 42 must be greater than the coefficient of thermal expansion $\beta_1$ for the pins 46 since the conductor 38, 42 shrink onto the pins 46 in order to effect the clamping engagement of the assembly 10. In all other respects the present invention according to this embodiment is similar to the embodiments discussed above.

While the particular connector assemblies as herein shown and disclosed in detail are fully capable of obtaining the objects and providing the advantage as herein before stated, it is to be understood that they are merely illustrative of the presently preferred embodiments of the invention and that no limitations are intended to the details of construction or design herein shown other than as defined in the appended claims.

I claim:

1. A connector for holding together a plurality of electrical conductors comprising:

means on said connector for placing said conductors into electrical contact with a predetermined orientation, said connector and said conductors having sufficiently different coefficients of thermal expansion to cause differential shrinkage for creating a clamping engagement therebetween when said connector and said conductor are subjected to extremely low temperatures.

2. A connector as cited in claim 1 wherein said means is a grip having recesses formed therein and said conductors are formed with extensions insertable into said recesses while at relatively high temperatures.

3. A connector as cited in claim 1 wherein said means is a pin and said conductors are formed with recesses for receiving at least a portion of said pin therein.

4. A connector as cited in claim 3 wherein said pin is a silver moly and said conductors are copper.

5. A scarf joint comprising:

a first conductor having a relatively low coefficient of expansion and formed with a first,scarf;

a second conductor having a relatively low coefficient of expansion and formed with a second scarf, said second scarf fayed to said first scarf; and a sheath having a relatively high coefficient of expansion disposed in surrounding relation with said fayed first and second scarfs for loose engagement therewith at a relatively high temperature and for clamping engagement therewith at a relatively low temperature.

6. A scarf joint as cited in claim 5 wherein said conductors are copper and said sheath is aluminum.

7. A connector assembly comprising:

a first conductor having an extension;

a second conductor having an extension; and a grip having a first recess for receiving said extension of said first conductor and having a second recess for receiving said extension of said second conductor, said grip comprising a material with having a sufficiently lower coefficient of thermal expansion than the coefficient of thermal expansion for said conductors to cause said grip to shrink and clampingly engage said extensions when said grip is subjected to extremely low temperatures.

* * * * *